US010247479B2

(12) United States Patent
Jepson

(10) Patent No.: US 10,247,479 B2
(45) Date of Patent: Apr. 2, 2019

(54) VORTEX WELL INERTING

(71) Applicant: Air Liquide Industrial U.S. LP, Houston, TX (US)

(72) Inventor: Stewart C. Jepson, Berwyn, IL (US)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 433 days.

(21) Appl. No.: 15/207,697

(22) Filed: Jul. 12, 2016

(65) Prior Publication Data

US 2018/0017329 A1 Jan. 18, 2018

(51) Int. Cl.

| | |
|---|---|
| ***F27D 3/16*** | (2006.01) |
| ***F27D 7/02*** | (2006.01) |
| ***F27B 3/22*** | (2006.01) |
| ***F27B 3/02*** | (2006.01) |

(52) U.S. Cl.

CPC ..... *F27D 3/16* (2013.01); *F27B 3/02* (2013.01); *F27B 3/22* (2013.01); *F27D 7/02* (2013.01); *F27D 2003/167* (2013.01); *F27D 2007/023* (2013.01); *F27M 2001/012* (2013.01)

(58) Field of Classification Search

CPC ..... F27B 3/16; F27B 3/02; F27B 3/22; F27D 7/02

USPC ..... 75/680

See application file for complete search history.

(56) References Cited

U.S. PATENT DOCUMENTS 8,932,385 B2 1/2015 La Sorda

OTHER PUBLICATIONS

Das, S.K., "Reduction of Oxidative Melt Loss of Aluminum and Its Alloys", DOE Report DE-FC36-00ID3898, Feb. 2000, pp. 1-50.

Van Linden, J., et al., "New Melt Technology for Aluminum Recycling," Proceedings from the 7th International Extrusion Technology Seminar, May 16-29, 2000, Chicago, pp. 143-148.

*Primary Examiner* — Edward M Johnson

(74) *Attorney, Agent, or Firm* — Elwood L. Haynes

(57) ABSTRACT

A method of providing an inerting atmosphere to the surface of molten aluminum in a vortex charge well of a reverberatory melting furnace is provided. The purpose is to improve aluminum recovery (reduce aluminum oxidation melt loss) by displacing the ambient atmosphere above the molten vortex with an inert gas. The method includes introducing a flow of an inerting gas into an inerting region immediately above the surface of the vortex charge well. The inerting gas may be selected from the group consisting of nitrogen, argon, or a mixture thereof. The inerting gas may be introduced into the charge inlet chute, through a diffuser, or a ring manifold. The vortex charge well may include a lid.

15 Claims, 11 Drawing Sheets

View AA

View AA

View BB

View AA

View BB

View BB

View AA

View AA

View AA

VORTEX WELL INERTING

BACKGROUND

Side well-charged reverberatory aluminum melting furnaces were developed to provide improved aluminum recovery (reduced aluminum melt loss) as compared to direct-charged, direct-fired reverberatory aluminum melting furnaces. Aluminum melt loss, or undesired oxidation of aluminum during the melting process, is a large cost to the industry, and can range from roughly 0.5% to as much as 5% of the incoming scrap charge, depending on the type of scrap and the melting process. (Das, Subodh K. "Reduction of Oxidative Melt Loss of Aluminum and its Alloys", DOE Report #DE-FC36-OOID13898, February 2006)

Over the years, various melting processes, techniques, burner types and practices have been developed with a focus on minimizing aluminum melt loss, however melt loss remains a significant cost to the industry, and there is room for further improvement.

In the direct-fired furnace, aluminum charge materials are placed directly into the main hearth, where the burners (typically natural gas, fuel oil or other fossil fuel) fire directly onto the charge pile. In these furnaces, melting is a batch process, and there can be direct flame impingement onto the charge materials.

With lighter gauge (thinner section) scrap types, with direct flame impingement typically melt loss (aluminum oxidation) is increased. With thicker sections of aluminum scrap, such as sows, T-bars, ingot crops or larger castings, due to the high thermal conductivity of solid aluminum, heat from direct flame impingement is quickly conducted through the aluminum. Due to the relatively low surface area to mass (volume) ratio, surface temperatures do not rise to excessive levels, as the heat can be conducted into the interior of the aluminum mass. The temperature of the large solid scrap piece essentially rises uniformly. However, with thinner pieces of aluminum scrap, with higher surface area to mass (volume) ratios, with direct flame impingement surface temperatures can rise more quickly, to much higher levels, as there is less mass to conduct away heat applied to the surfaces. Surfaces can start to melt, and oxidize, more quickly, especially with direct flame impingement. This phenomenon defines a theoretical critical scrap thickness. Below this critical scrap thickness, melt loss can be increased significantly. (Van Linden, Jan and Vild, Chris "New Melt Technology for Aluminum Recycling", Proceedings from the $7^{th}$ International Extrusion Technology Seminar ET 2000, page 143)

For this reason, side well-charged aluminum reverberatory melt furnaces were developed. Scrap pieces with higher surface area to mass ratios, such as sheet punchings, castings gates, risers and returns, strip and lighter gauge castings are charged into the side well, away from direct flame or flue gas contact. In the side charge well, the scrap is quickly submerged. In this manner contact with ambient air is also minimized. Molten metal pumps are commonly employed, to circulate molten aluminum between the main hearth and the side well. This molten metal circulation greatly improves heat transfer and melting thermal efficiency, and also greatly improves homogeneity of metal chemistry and temperature.

The side well-charged aluminum reverberatory melt furnace also makes it possible to have more of a continuous charge/melt operation, as opposed to strictly batch melting.

In these side well-charged melt furnaces, it is advantageous to maintain the molten aluminum surfaces very still and quiescent, with minimum agitation or turbulence. A relatively thin dross (aluminum oxide) layer forms on top of the molten aluminum surface, whether exposed to ambient air (side wells) or the burner products of combustion (main hearth). This thin dross layer acts as a protective barrier, to retard further aluminum oxidation. Whenever this dross layer is broken, by any surface agitation or turbulence or "surface rippling" effect, then more fresh molten aluminum is exposed to the atmosphere, and aluminum oxidation is increased. In order to maintain a quiet, undisturbed flat bath surface, the molten aluminum circulation (pumping) is accomplished underneath the molten surface. Molten aluminum circulates between the side wells and main hearth via "submerged arches", passageways below the molten aluminum surface level, built into the barrier wall that separates the main hearth from the side wells.

While the side well-charged furnace has been shown to increase yield (reduce melt loss) for many types of thinner section, lighter gauge scrap, for very thin section types of scrap such as machine chips or UBC (used beverage can) shreds, the special vortex charge well was developed to further improve yield (see FIG. 1). Very thin-section aluminum scrap pieces, such as machine chips or shreds, will often float on the surface of the charge well, when charged into a conventional side well furnace. Since they are not readily submerged, while floating on the molten surface they remain exposed to the ambient atmosphere, where melt loss (oxidation) can occur as they heat up. Heat transfer efficiency can also be greatly improved if these chips/shreds could be more rapidly submerged. In some situations, mechanical "puddlers" are employed to periodically push these floating light gauge scrap pieces underneath the charge well surface. However, these mechanical devices can increase melt loss, since the molten aluminum surface and protective dross layer is agitated, exposing more fresh molten aluminum to the atmosphere.

The vortex charge well concept is shown in FIGS. 1, 2, and 4. A specially designed, bowl-shaped chamber 101 is placed between the pump well 102 and charge well 103, as shown in FIG. 1. In this chamber 101, the molten aluminum travels in a swirling pattern, creating a concave "vortex" or "toilet bowl" effect. When light gauge machine chips or shreds 110 are charged into this V-shaped molten aluminum vortex, they are very rapidly pulled under the surface. This reduces aluminum oxidation by keeping the chips/shreds 110 away from ambient air contact, and it also improves heat transfer efficiency.

While these vortex charge wells improve aluminum recovery (reduce aluminum oxidation) by more quickly and effectively submerging the light gauge solid aluminum charge pieces 110, they also contribute to some additional aluminum oxidation by virtue of their configuration. In order to create the molten aluminum vortex shape, molten aluminum is continuously exposed and re-exposed to the ambient atmosphere. The relatively flat, quiet and undisturbed molten aluminum surface is now agitated, in the vortex area, and fresh molten aluminum is continually brought to the surface and exposed to ambient air. In some cases, one can see an aluminum oxide crust or skin continually forming, breaking up, and pieces of oxide repeatedly being pulled under the vortex. These aluminum oxides then float to the top in the adjoining charge well or "float out well" 103, since this side charge well is still and with an undisturbed flat bath surface. This additional aluminum oxide is periodically skimmed out of the charge well (float out well), increasing the total dross skimming requirement.

SUMMARY

A method of providing an inerting atmosphere to the surface of molten aluminum in a vortex charge well of a reverberatory melting furnace is provided. The purpose is to improve aluminum recovery (reduce aluminum oxidation melt loss) by displacing the ambient atmosphere above the molten vortex with an inert gas. The method includes introducing a flow of an inerting gas into an inerting region immediately above the surface of the vortex charge well. The inerting gas may be selected from the group consisting of nitrogen, argon, or a mixture thereof. The inerting gas may be introduced into the charge inlet chute, through a diffuser, or a ring manifold. The vortex charge well may include a lid.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

DESCRIPTION OF EMBODIMENTS

Figure 1:
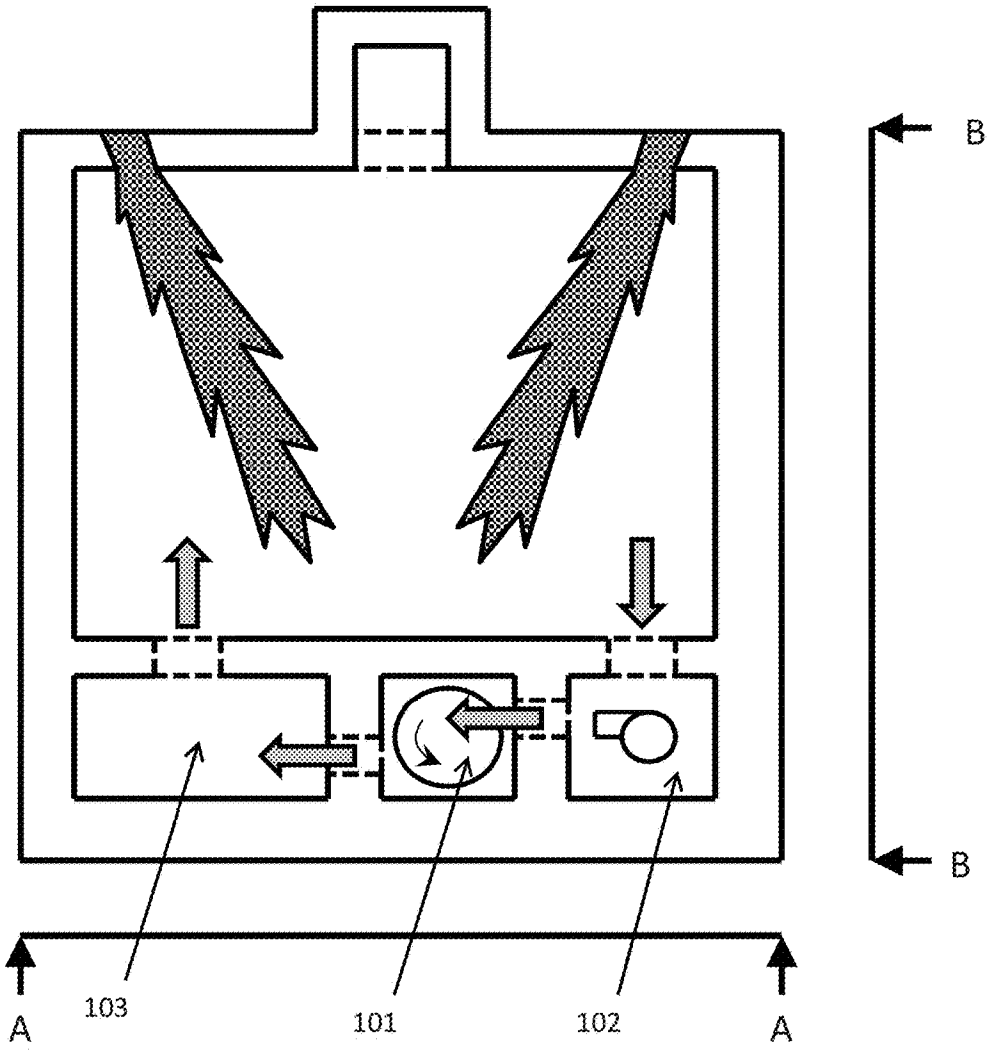
FIG. 1 is a schematic representation (top view) of a side well-charged aluminium melting furnace with a vortex charge well.
Figure 2:
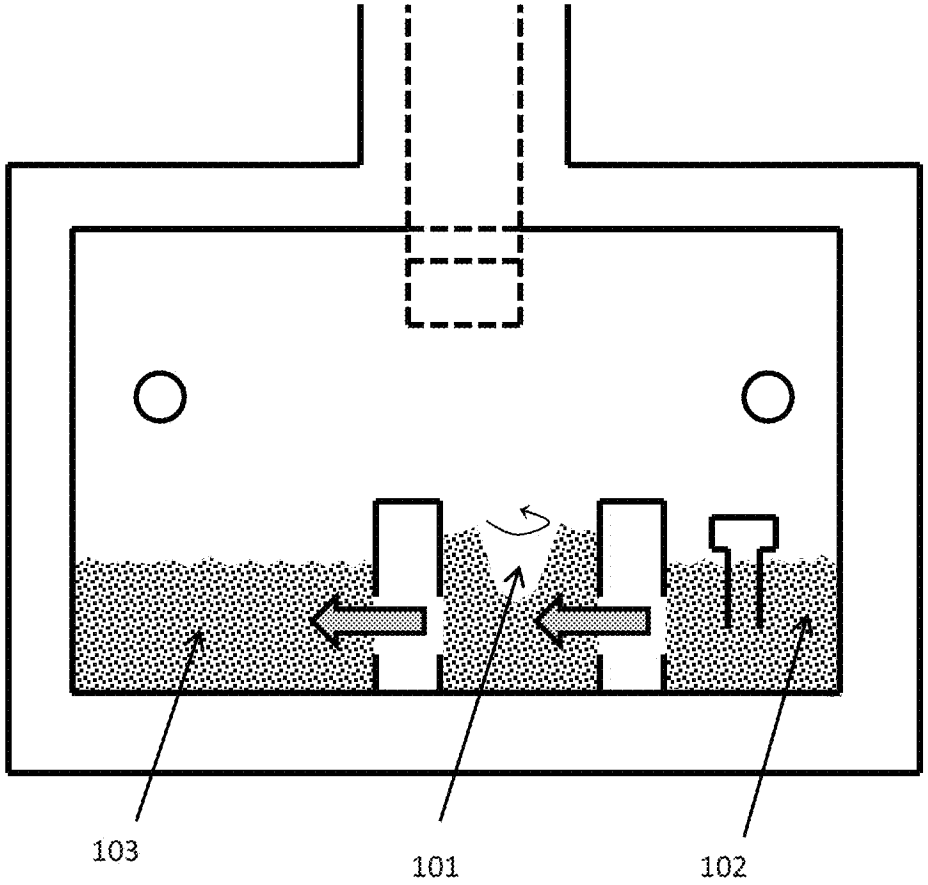
FIG. 2 is a schematic representation (end view . . . view AA) of a side well-charged aluminium melting furnace with a vortex charge well.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Figure 3:
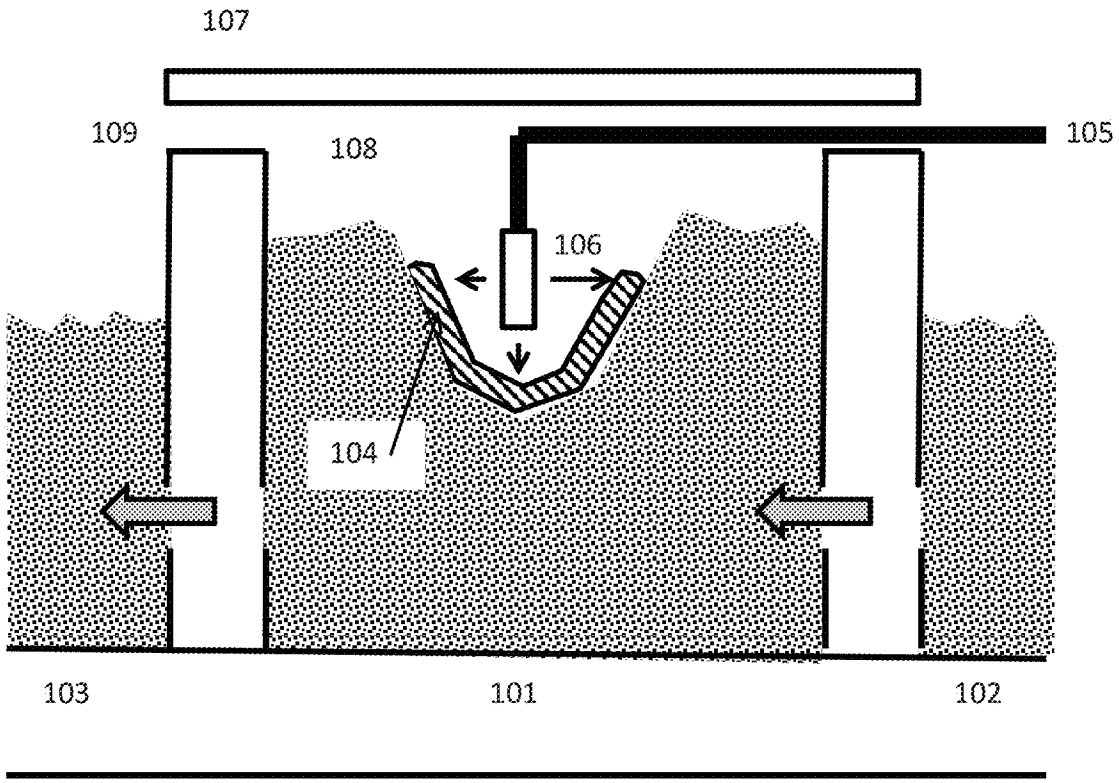
FIG. 3 is a schematic representation (end view . . . view AA) of a side well-charged aluminium melting furnace with a vortex charge well, focusing on the vortex well, with a inert gas diffuser, in accordance with one embodiment of the present invention.
Figure 4:
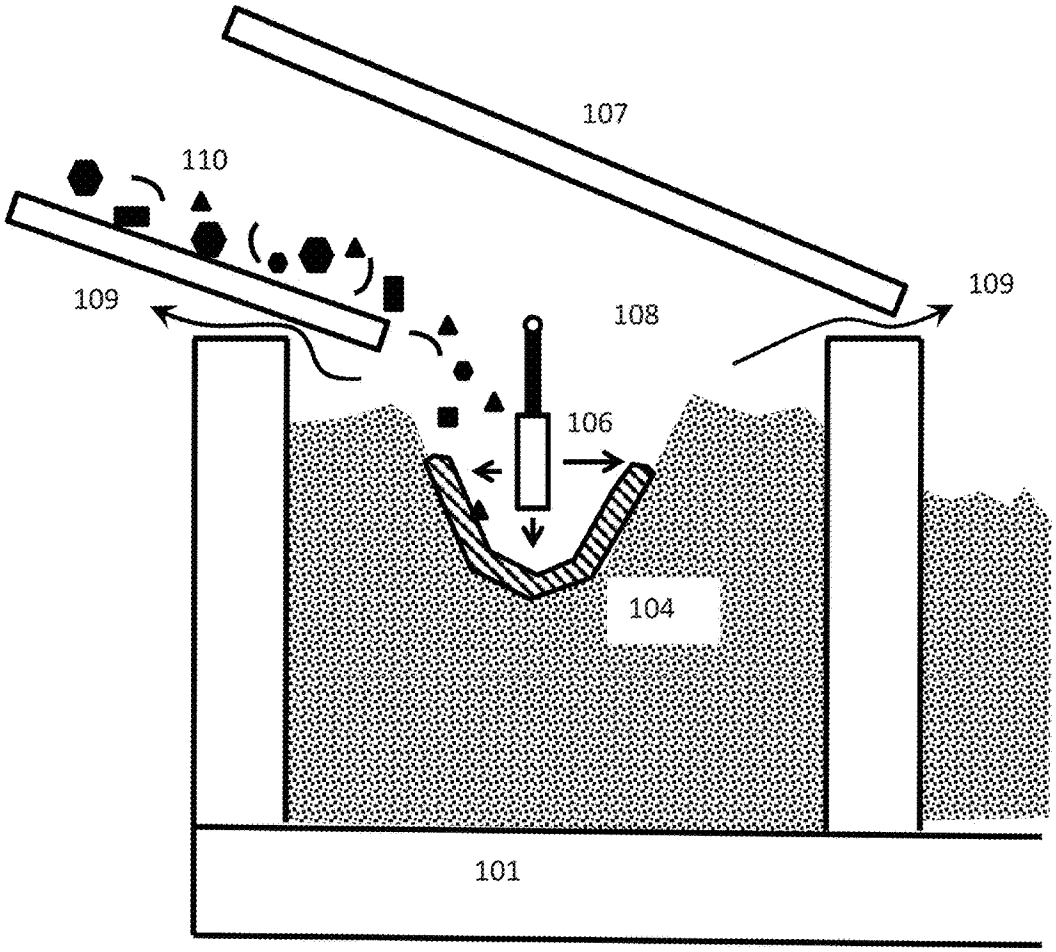
FIG. 4 is a schematic representation (side view . . . view BB) of a side well-charged aluminium melting furnace with a vortex charge well, focusing on the vortex well, with a inert gas diffuser, in accordance with one embodiment of the present invention.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure FIGS. 3 and 4 show an embodiment for gas inerting the area 104 immediately above the vortex charge well 101. Gaseous nitrogen or argon 105 can be injected through a single diffuser 106, to disperse the inert gas 105 in a low velocity, uniform and non-turbulent manner. It is advantageous to inject this inert gas 105 as low as practically possible, near the bottom of the V-shaped vortex, since the gas will become heated and rise, and if starting low near the molten vortex surface it can act to push away or displace ambient air. High inert gas velocity or turbulence is not desired, since higher inert gas velocities can tend to infiltrate ambient air, and higher gas velocities could cause turbulence to agitate the molten metal surface. Uniform distribution of the inert gas (nitrogen or argon) is best, to spread in all directions so as to cover the entire V-shaped vortex, at low velocity to minimize turbulence.

A lid 107 can be utilized to improve the gas surface inerting effect. Since the inert gas 104 will become heated and rise away from the vortex surface, a lid 107 can help to contain the inert gas over the molten vortex. Ideally a slightly positive pressure can be formed under the lid 107, within the vortex surface headspace 108, to more effectively push ambient air (21% O2) away from the vortex surface and maintain the inert gas 104 cover. The lid 107 will be positioned to allow the gases to escape through a relatively small channel(s) 109, to maintain the desired atmosphere within the vortex head space 108.

As discussed above, while these vortex charge wells improve aluminum recovery by more quickly and effectively submerging the light gauge solid aluminum charge pieces 110, they also contribute to some additional aluminum oxidation by virtue of their configuration. In order to create the molten aluminum vortex shape, molten aluminum is continuously exposed and re-exposed to the ambient atmosphere. The present invention reduces or eliminates this exposure to the ambient atmosphere by forming the gas inerting area 104, directly above the surface of the vortex.

Figure 5:
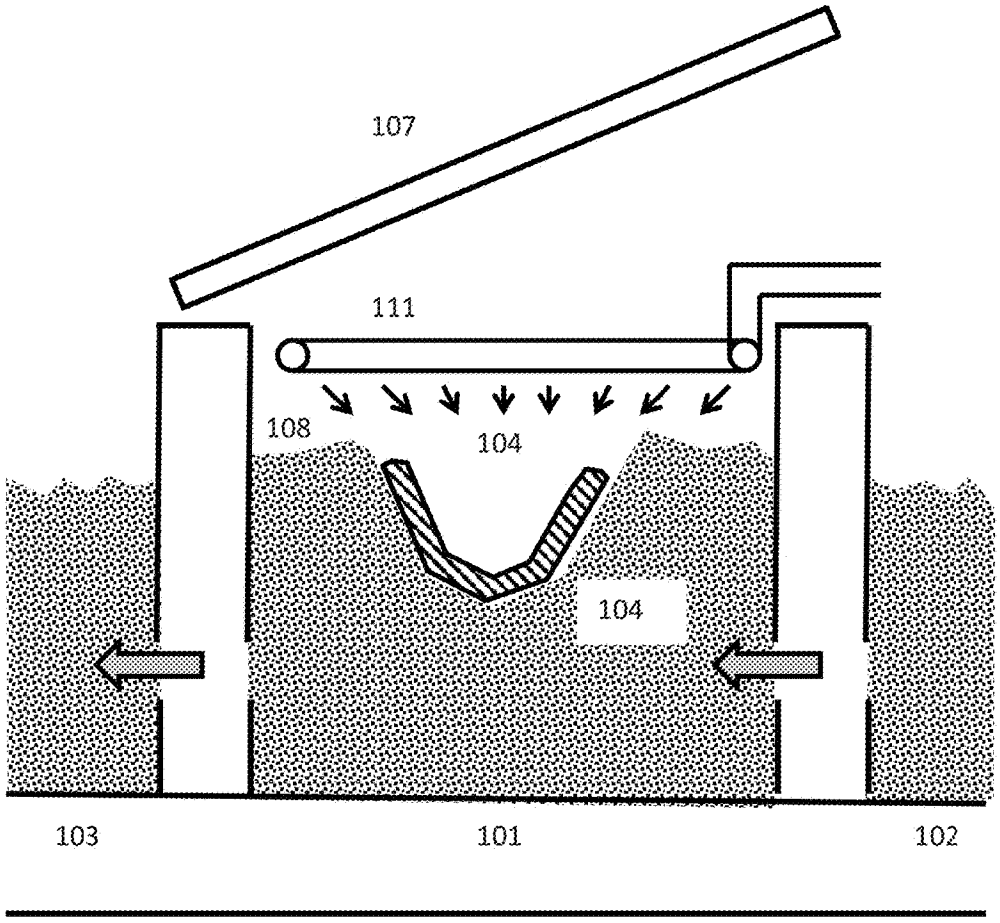
FIG. 5 is a schematic representation (end view . . . view AA) of a side well-charged aluminium melting furnace with a vortex charge well, focusing on the vortex well, with a inert gas ring manifold, in accordance with one embodiment of the present invention.
Figure 6:
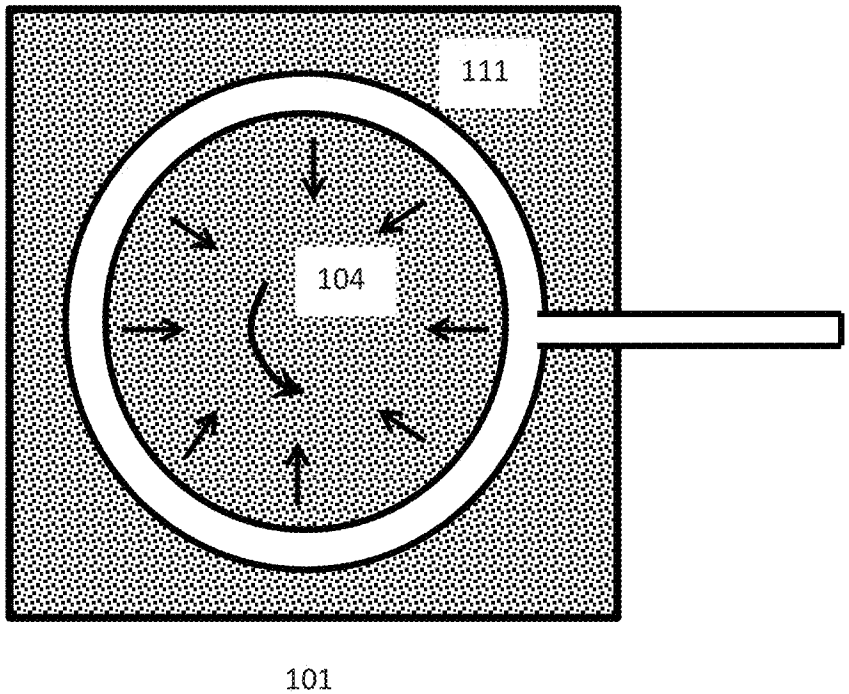
FIG. 6 is a schematic representation (top view) of a side well-charged aluminium melting furnace with a vortex charge well, focusing on the vortex well, with a inert gas ring manifold, in accordance with one embodiment of the present invention.
Figure 7:
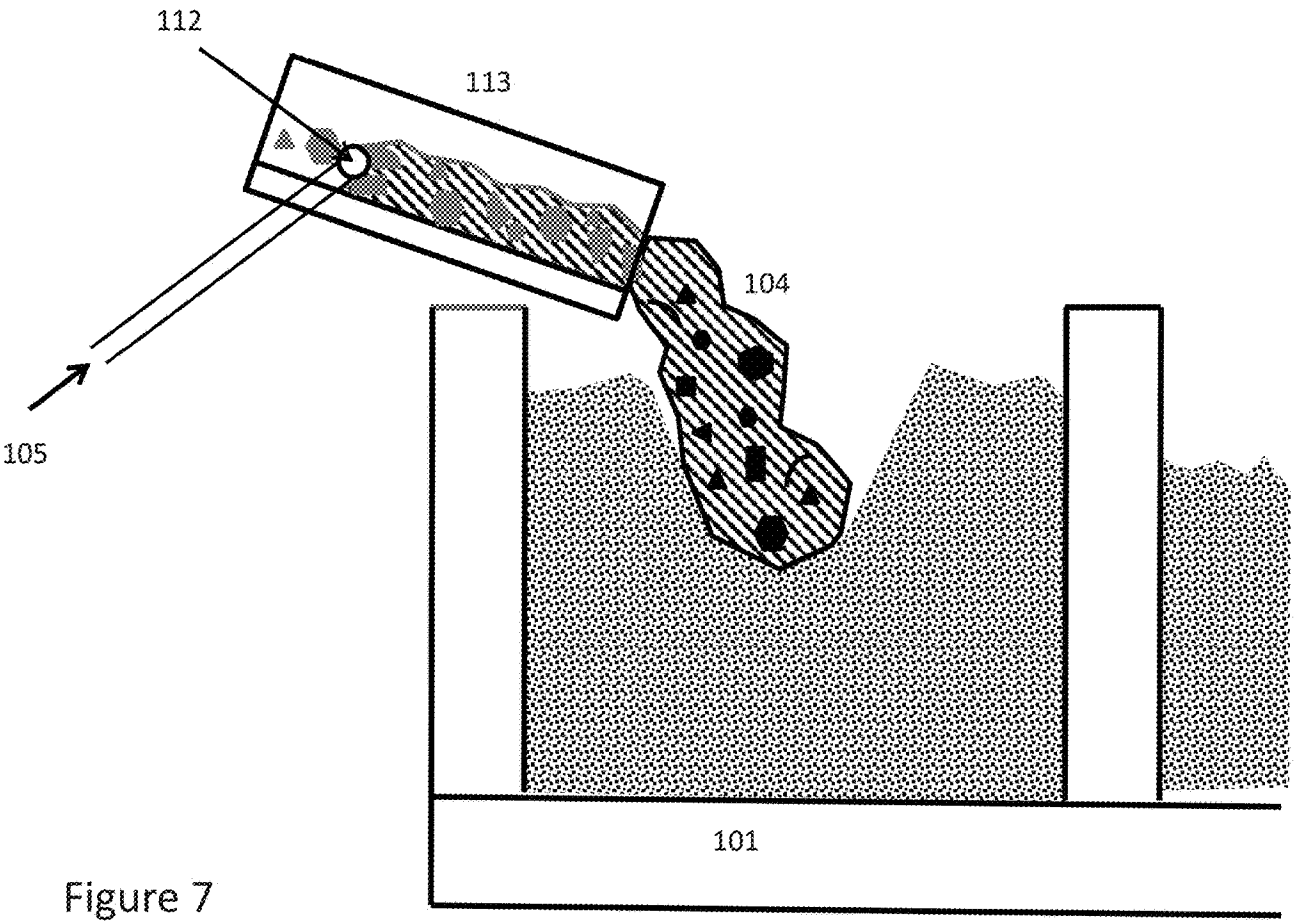
FIG. 7 is a schematic representation (side view . . . view BB) of a side well-charged aluminium melting furnace with a vortex charge well, focusing on the vortex well, with the inert gas introduced with the charge, in accordance with one embodiment of the present invention.
Figure 8:
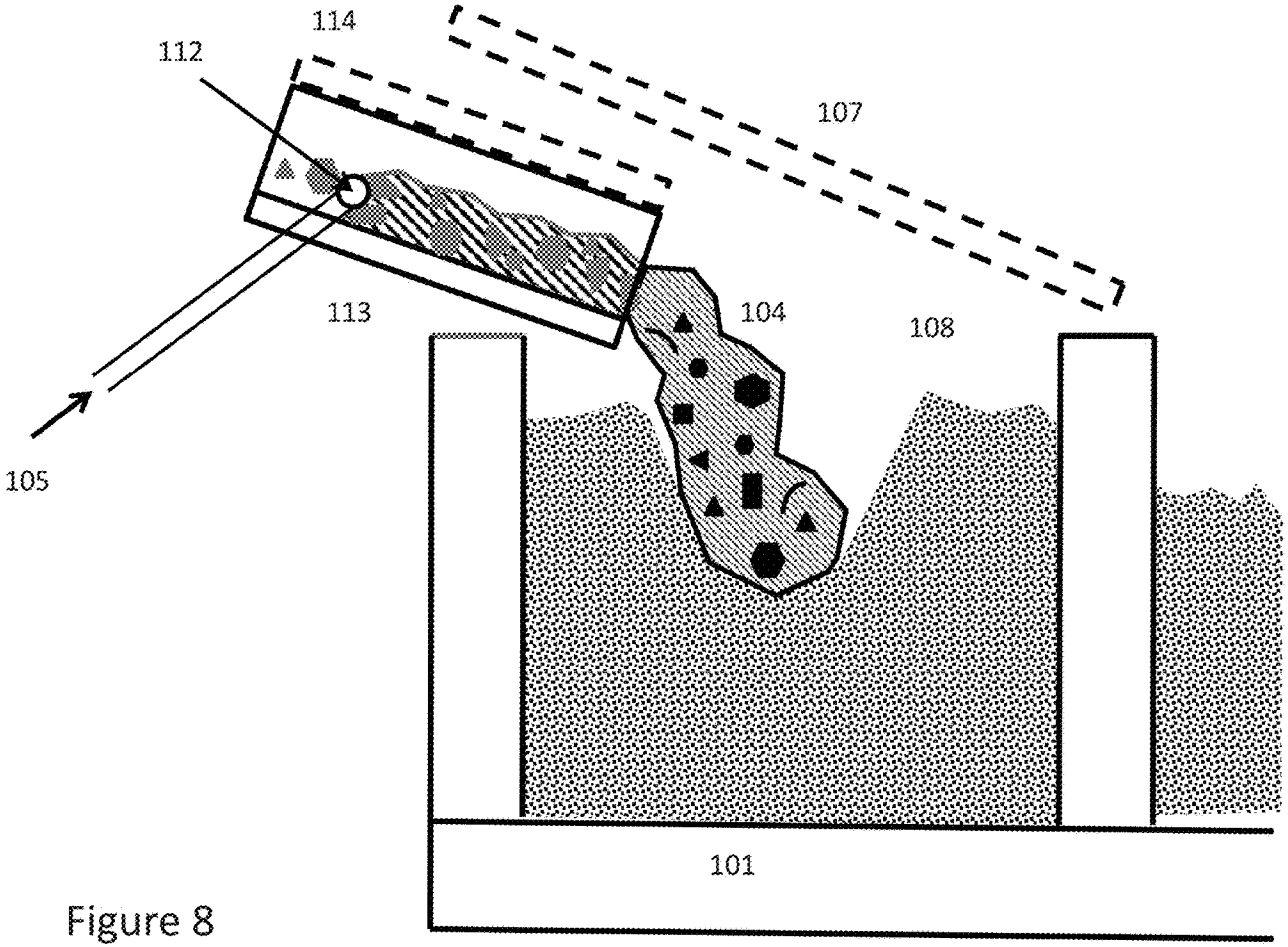
FIG. 8 is a schematic representation (side view . . . view BB) identical to FIG. 7, except illustrating optional lids on the charge chute and/or the vortex well, in accordance with one embodiment of the present invention.
Figure 9:
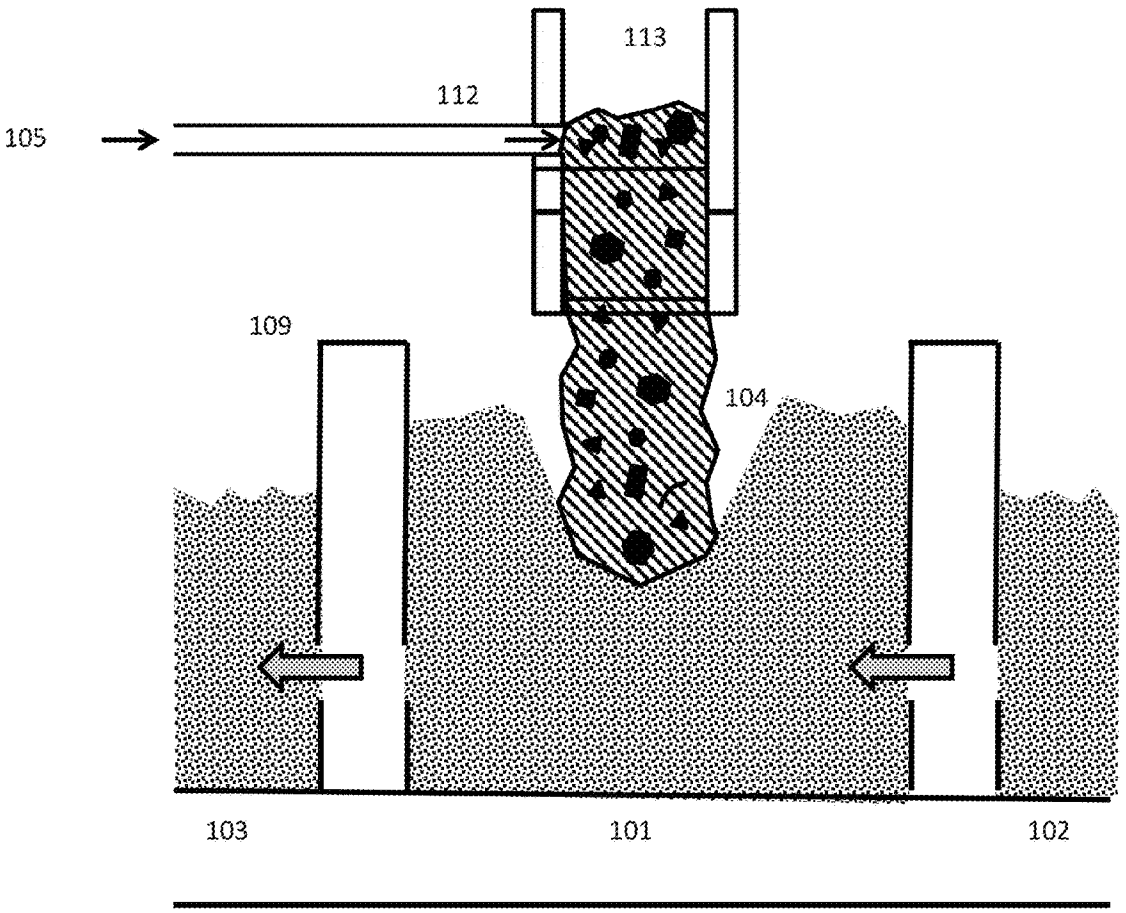
FIG. 9 is a schematic representation ((end view . . . view AA) of a side well-charged aluminium melting furnace with a vortex charge well, focusing on the vortex well, with the inert gas introduced with the charge, in accordance with one embodiment of the present invention.
Figure 10:
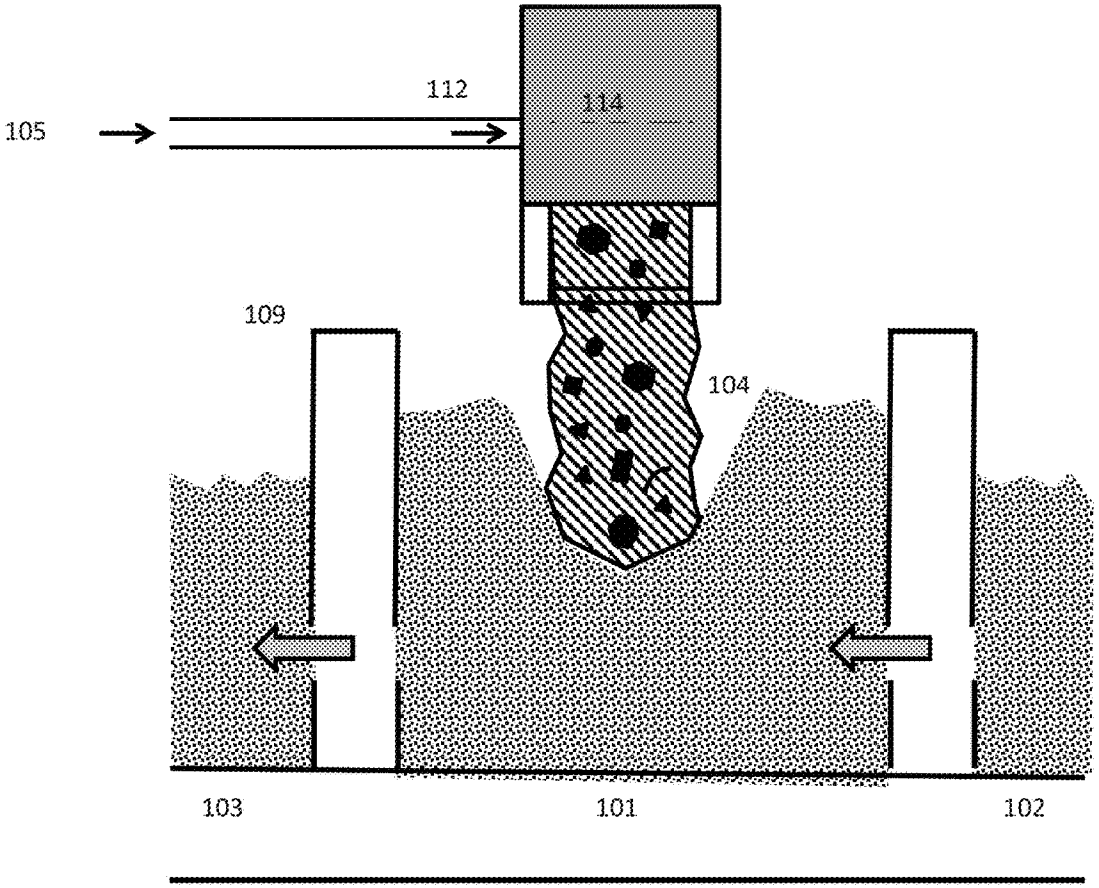
FIG. 10 is a schematic representation (end view . . . view AA) identical to FIG. 9, except illustrating optional lids on the charge chute, in accordance with one embodiment of the present invention.
Figure 11:
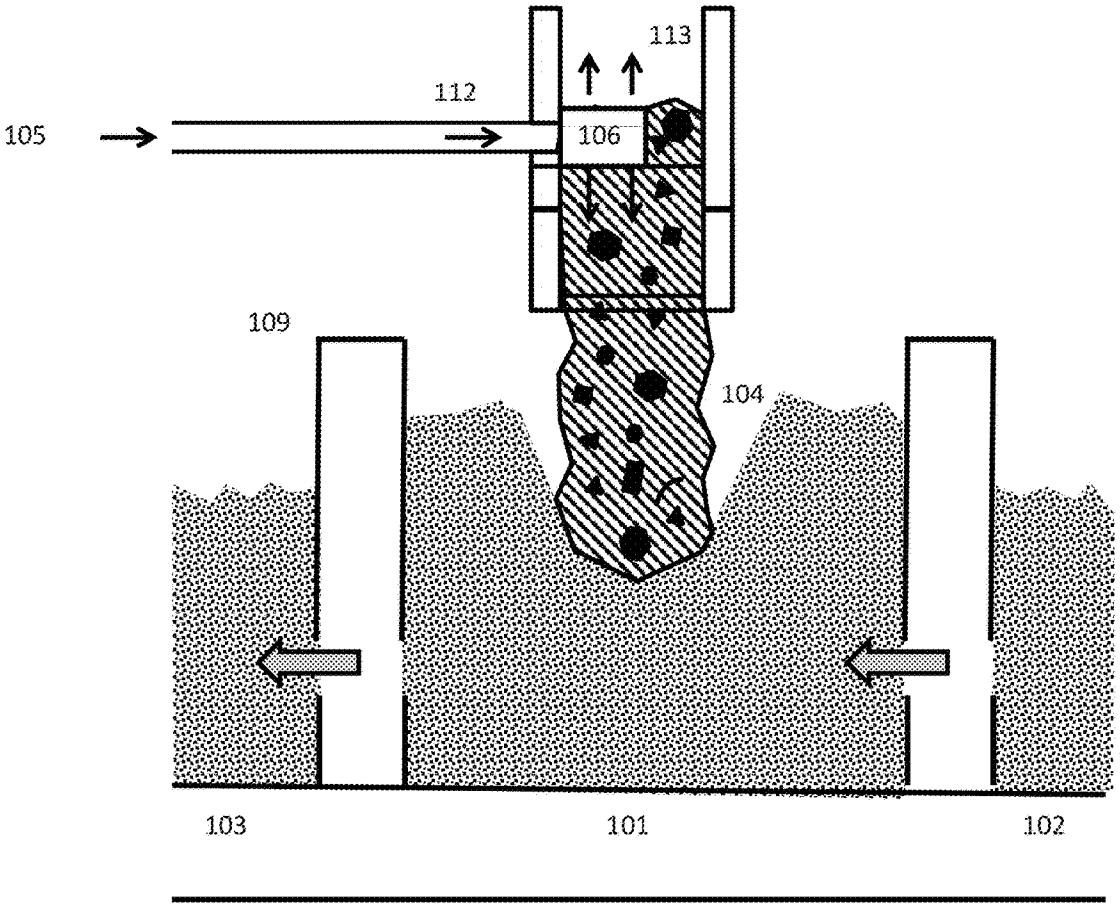
FIG. 11 is a schematic representation ((end view . . . view AA) of a side well-charged aluminium melting furnace with a vortex charge well, focusing on the vortex well, with the inert gas introduced with the charge through a diffuser, in accordance with one embodiment of the present invention.

As shown in FIGS. 5 and 6, in another embodiment it is advantageous to utilize a ring-manifold 111, or partial-ring manifold (not shown), mounted near the top circumference of the vortex head space 108, to direct the inert gas 104 downward along the surface of the vortex. This ring manifold 111 could be used alone, or in combination with a single center diffuser (not shown), and either with or without a lid 107.

It is estimated that the required flow rate of nitrogen or argon will be roughly 20 SCFM, for a vortex bowl of roughly 48" ID; flow rates can be adjusted for varying sizes and varying configurations, and to achieve the desired results. It is expected that the value of the improved aluminum yield (reduced aluminum melt loss) will significantly exceed the cost of the inert gas required (nitrogen or argon); this can be measured at any particular site by conducting a relatively short term trial or test.

FIGS. 7-11 show an embodiment for gas inerting the area 104 immediately above the vortex charge well 101. Gaseous nitrogen or argon 105 can be injected through an orifice 112, or a diffuser 106, to disperse the inert gas 105 in a low velocity, uniform and non-turbulent manner into the charge inlet chute 113. The inert gas 105 will be carried along with the incoming, finely divided charge material 110, especially in cases where the charged materials 110 are conveyed through an enclosed chute 114, or a partially enclosed U-shaped chute 113.

Some air can be entrained with the incoming finely divided charge materials 110, such as machine chips or shreds, which can have a "void fraction" when loosely packed, which is how they are typically conveyed in these charging mechanisms. In certain cases, including inert gas with the incoming charge materials 110 may improve the inerting effect, by displacing ambient air that can be entrained within the loosely packed, finely-divided incoming charge materials.

A lid 107 can be utilized to improve the gas surface inerting effect. Since the inert gas 104 will become heated and rise away from the vortex surface, a lid 107 can help to contain the inert gas over the molten vortex. Ideally a slightly positive pressure can be formed under the lid 107, within the vortex surface headspace 108, to more effectively push ambient air (21% 02) away from the vortex surface and maintain the inert gas 104 cover. The lid 107 will be positioned to allow the gases to escape through a relatively small channel(s) 109, to maintain the desired atmosphere within the vortex head space 108.

The skilled artisan will recognize that these embodiments may be combined as desired.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of providing an inerting atmosphere to the surface of molten aluminum in a vortex charge well of a reverberatory melting furnace, the method comprising: introducing a flow of an inerting gas into an inerting region immediately above the surface of the vortex charge well.

2. The method of claim 1, wherein the inerting gas is selected from the group consisting of nitrogen, argon, or a mixture thereof.

3. The method of claim 1, wherein the inerting gas is introduced into the inerting region through a diffuser.

4. The method of claim 3, wherein the diffuser is positioned proximate to the surface of the vortex charge well.

5. The method of claim 1, wherein the vortex charge well further comprises a lid.

6. The method of claim 1, wherein the inerting gas is introduced into the inerting region thorough a ring manifold.

7. The method of claim 6, wherein vortex charge well comprises a vortex headspace comprising a top circumference, and wherein the ring manifold is positioned near the top circumference of the vortex headspace.

8. The method of claim 1, wherein the inerting gas is introduced into the inerting region thorough a partial ring manifold.

9. The method of claim 8, wherein vortex charge well comprises a vortex headspace comprising a top circumference, and wherein the ring manifold is positioned near the top circumference of the vortex headspace.

10. The method of claim 1, wherein the inerting gas is introduced into the inerting region through both a diffuser and a ring manifold.

11. The method of claim 6, wherein the vortex charge well further comprises a lid.

12. A method of providing an inerting atmosphere to the surface of molten aluminum in a vortex charge well of a reverberatory melting furnace, the method comprising: introducing a flow of an inerting gas into a charge inlet chute, whereby the inerting gas travels with a stream of aluminum charge pieces and into an inerting region immediately above the surface of the vortex charge well.

13. The method of claim 12, wherein the inerting gas is selected from the group consisting of nitrogen, argon, or a mixture thereof.

14. The method of claim 12, wherein the charge inlet chute further comprises a lid.

15. The method of claim 12, wherein the vortex charge well further comprises a lid.

* * * * *